US005207508A

United States Patent [19]

Koutsis, Jr.

[11] Patent Number: 5,207,508

[45] Date of Patent: May 4, 1993

[54] CONVERTIBLE SACK

[76] Inventor: Philip Koutsis, Jr., 112 Highland Ave., Eastchester, N.Y. 10707

[21] Appl. No.: 786,064

[22] Filed: Oct. 31, 1991

[51] Int. Cl.[5] ..... B65D 33/10

[52] U.S. Cl. ..... 383/4; 383/33; 383/74; 383/75; 383/76; 135/95

[58] Field of Search ..... 383/4, 33, 74, 75, 76; 190/1, 2; 5/417, 418; 135/95, 98, 102, 115, 22

[56] References Cited

U.S. PATENT DOCUMENTS

| | | | |
|---|---|---|---|
| 2,543,597 | 2/1951 | Peery | 383/4 X |
| 3,173,435 | 3/1965 | Jaime | 135/95 |
| 4,180,112 | 12/1979 | Bovet | 383/4 |
| 4,337,812 | 7/1982 | Trinkner | 383/75 X |
| 4,499,133 | 2/1985 | Prince | 135/95 X |
| 4,606,070 | 8/1986 | Schachter | 190/1 X |
| 4,778,090 | 10/1988 | Facchina | 383/4 X |
| 4,794,029 | 12/1988 | Tennant et al. | 383/4 X |
| 4,991,978 | 2/1991 | Ostrowski | 383/4 |
| 5,033,497 | 7/1991 | Hernandez | 135/95 |
| 5,059,463 | 10/1991 | Peters | 5/417 X |

FOREIGN PATENT DOCUMENTS

| | | | |
|---|---|---|---|
| 2647087 | 11/1990 | France | 383/4 |
| 442987 | 12/1949 | Italy | 135/95 |

*Primary Examiner*—Allan N. Shoap
*Assistant Examiner*—Jes F. Pascua
*Attorney, Agent, or Firm*—Ronald J. Kransdorf

[57] ABSTRACT

A convertible sack is provided which alternatively functions as a sack or tote for carrying objects and as a surface usable for a variety of functions. The sack is formed of a sheet of a flat, subtle material with a hollow circular section, access openings and a cord secured therein. The sack is converted from a flat surface into a sack by pulling the cord through the access openings. The convertible sack has various applications including use as a combination beach tote/blanket, combination diaper bag/changing pad, combination meal tote/seat and combination sack/tent. At least one surface of the sack may be water resistant.

9 Claims, 3 Drawing Sheets

CONVERTIBLE SACK

FIELD OF THE INVENTION

This invention relates to a sack or tote for carrying objects which can be converted to a surface usable for a variety of functions.

BACKGROUND

Individuals working or playing outdoors often must carry numerous objects to be used in such endeavor, in addition to a blanket or mat upon which the individual(s) can sit or repose, or a cover which can be used as a tent-like structure to protect against sun, rain or other elements. Similar requirements exist when attending outdoor sporting or cultural events, picnics, or the like or when transporting an infant. Typically the objects are placed in some type of bag or tote and the blanket/cover is folded or rolled for transport.

This procedure presents several problems. First, it is frequently difficult to find a desired item, particularly a small item, in the bag. Rummaging in a bag to find items is time consuming and frustrating. If the contents of the bag are emptied on for example, a blanket to facilitate use, the bag must be repacked, another time consuming process. Even if the bag is not emptied, objects used must be repacked at the end of the activity.

Second, the need to carry both a bag and a blanket/-cover, increases both the bulk and weight which the individual must carry. This is undesirable in all situations, and is particularly so in activities such as hiking or biking where the load must be carried, frequently for considerable distance.

A need therefore exists for an improved tote or sack for outdoor activities, for babies or for similar situations where there is a need for both numerous objects and for a blanket/cover which facilitates easy packing and unpacking of the sack, which provides ready access to all objects in the sack and which substantially reduces the weight and bulk of items to be carried.

SUMMARY OF THE INVENTION

It is therefore an object of the present invention to provide a sack or tote which can be quickly and easily packed and unpacked.

A further object of the invention is to provide a sack or tote which can be converted into a surface usable for a variety of functions.

These and other objects are realized in a sack which can be converted into a generally flat surface. The sack is formed from a flat, subtle material which can be converted into a closed configuration by fastening a cord lying within a generally circular, hollow circumferential section of the material. The circumferential section need not form a perfect circle but could include, for example, an elliptical or oval shape. The overall shape of the material is not limited to a generally circular shape but may take a variety of forms, provided that the material includes a generally circular, hollow section formed therein. Thus, for example, a generally circular, hollow section formed in a rectangularly shaped blanket would fall within the scope of the present invention.

The circular section further includes openings through which the cord can be accessed. The openings may be present on only one side of the material or may penetrate through both sides of the material. Alternatively, the openings may be placed on the perimeter of the material to provide a reversible sack. Preferably, the openings are approximately evenly spaced about the circular section such that pulling the cord through the openings results in a closed or "sack" configuration. Accordingly, pulling the cord means converts the sack from an open configuration, i.e., a generally flat surface, to a closed, sack configuration. The cord may be formed of a variety of strong, light weight materials which are easy to grasp. In one embodiment, the cord is made of a synthetic material, e.q., plastic tubing with a stiff wire core characterized by being capable of extending to a fully extended configuration. In this embodiment, unclamping or unfastening the cord results in extension of the cord, thereby facilitating conversion of the sack from a closed to an open configuration. There is no requirement that the fastening cord itself be formed of the above-described material to provide a sack having the disclosed self-opening feature. For example, a self opening sack could also be provided by placing a second cord formed of the above-described material in position parallel to the fastening cord.

The fastening cord may be pulled through any or all of openings in the circular section. The more openings through which the cord is pulled, the shorter the lengths of the cord present in each loop of cord will become. Thus, the cord also serves as a shorter handle or as a longer shoulder strap, depending upon the initial length of the cord and the number of openings through which it is pulled. Shoulder straps may also be attached to the sack to facilitate its transport.

The sack has an inner surface and an outer surface. The material comprising these surfaces may be the same or different and may be formed of natural or synthetic materials. In general, inner surface refers to the surface upon which an individual sits when the convertible sack is in an open configuration. The outer surface refers to the surface which contacts the ground when the sack is used as a blanket or mat in an open configuration. The inner and outer surfaces of the sack may be interchangeable, i.e., a reversible sack. Thus, for example, in a sack having openings circumscribing its perimeter or having openings which penetrate both surfaces, the inner and outer surfaces may be used interchangeably.

In one preferred embodiment, the inner and outer surfaces are formed of different materials having different desired properties. For example, a convertible sack which functions as a combination beach tote/blanket has an inner surface made of a material, e.g. terry cloth, upon which an individual can comfortably recline when clothed in bathing apparel and an outer surface which is water resistant or treated to provide a water-resistant surface. The combination beach tote/blanket can be folded in half, wrapped around the waist and also used as a beach strong by tying together or otherwise securing the opposite ends of the cord or drawstring. Thus, for example, wrapping the sack about the waist provides a beach coverup as well as a convenient way of carrying objects while walking to or along the beach. When the individual wants to lie on the sand, he or she unfastens the sack and uses it in an open, blanket configuration.

The sack may be formed of natural or synthetic materials, may be formed entirely of a single fabric (for example, terry cloth) and/or may be made of a light weight, strong, subtle fabric (for example, canvas). The sack may also be formed of a disposable material, such as plastic. Thus, a plastic sack in an extended configuration may be used as a surface upon which leaves may be raked. When raking is complete, the leaves are conveniently "bagged" by pulling the cord through the openings, thereby converting the flat sheet to a closed sack configuration. In several preferred embodiments, at least one surface of the convertible sack is formed of a water resistant material or is otherwise treated to provide a water resistant surface. Thus, in one embodiment, a convertible sack which functions as a combination diaper bag/changing pad, has a water resistant inner surface. In yet another embodiment which functions as a combination sack/picnic blanket, it may be desirable to have both surfaces water resistant to ensure that neither surface of the sack is wet by contact with damp earth or by the inadvertent spilling of food or drink.

The sack may further include clamping elements capable of clamping or otherwise securing the cord and maintaining the sack in a closed configuration. The clamping elements may be a clamp, such as those which are available for securing the drawstring of a duffle bag. Other examples of clamping elements include snaps or hook and pile type fasteners, (e.q., Velcro®) which may be placed around the cord to hold it in a gathered position. The clamp may be attached to or near the circular section of the sack in a manner such that it can be easily located for use, or may be located remote from the circular section to provide an attachment site for a relatively long loop of cord, (e.q. a cord pulled through a single opening in the circular section.

Attachment elements may be attached to the sack to provide an attachment site for additional straps of varied length and thickness. Preferably, shoulder straps are attached to larger sacks, such as a combination beach tote/blanket, to facilitate carrying. The attachment elements may also be used to attach other objects to the sack. Thus, for example, a convertible sack which functions as a combination sack/tent can include attachment elements for attachinq supports to the outer surface of the sack. Such supports, e.q., telescopic tent poles, provide a structure upon which the open sack can be disposed, to shield the user from exposure to undesirable weather conditions.

These objects, as well as other objects, features and advantages of the invention will be apparent to those skilled in the art from the following detailed description thereof, taken in conjunction with the drawinqs.

DETAILED DESCRIPTION OF A PREFERRED EMBODIMENT

Figure 1:
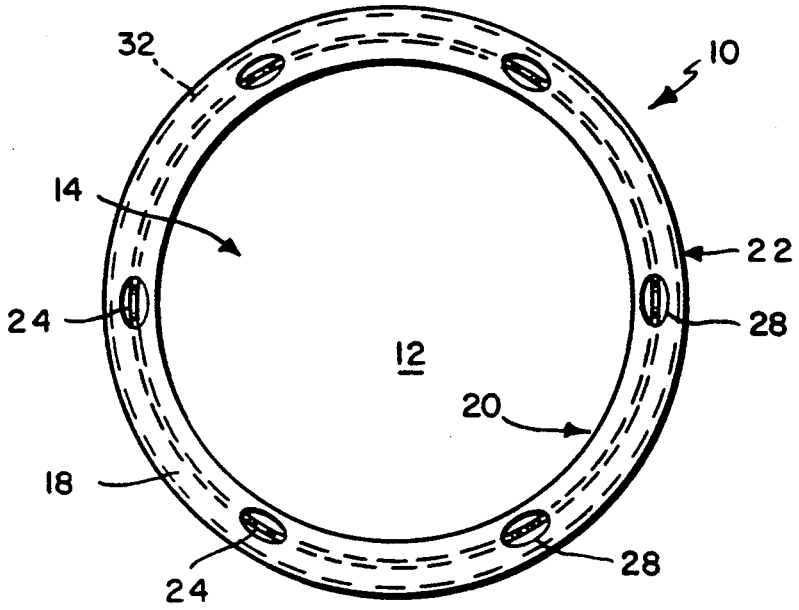
FIG. 1 is a top view of a convertible sack of a first embodiment having a circular perimeter, shown in an open configuration.
Figure 2:
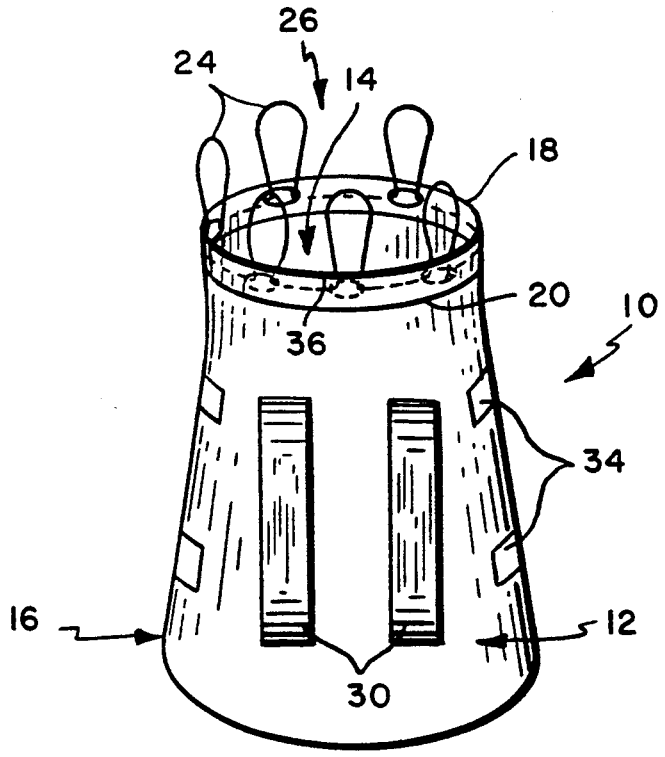
FIG. 2 is a side perspective view of the convertible sack of FIG. 1, shown in a closed configuration, with the cord pulled through several openings.
Figure 5:
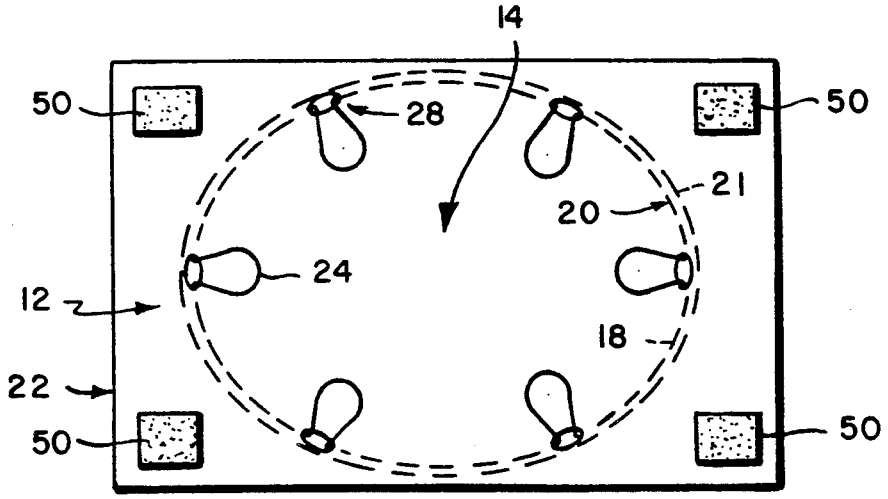
FIG. 5 is a top view of a convertible sack of an alternative embodiment having a rectangular perimeter, shown in an open configuration.
Figure 6:
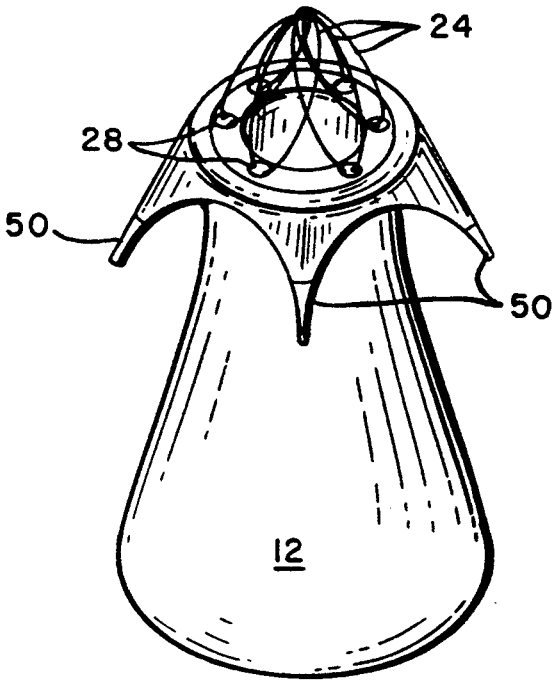
FIG. 6 is a side perspective view of the convertible sack embodiment of FIG. 5 in a closed configuration.
Figure 7:
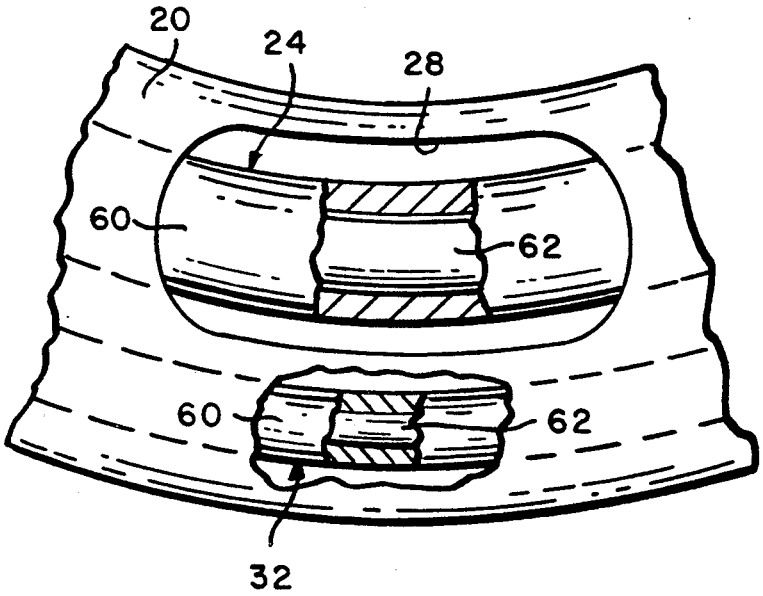
FIG. 7 is an expanded view of a portion of convertible sack of FIG. 1.

Referring to FIGS. 1–2, a convertible sack for a first embodiment 10 of the invention is shown is an open configuration (FIG. 1) and a closed configuration (FIG. 2). Convertible sack 10 is formed of a generally flat sheet of material 12 having an inner surface 14, an outer surface 16, a circular circumferential section 18 and a perimeter 22. Sheet 12 may take a variety of shapes, provided that circumferential section 18 is sufficiently circular to allow a drawstring cord to be easily pulled through a hollow of the circumferential section. Thus, perimeter 22 may, for example, define a circle (FIG. 1) or a rectangle (FIG. 5). If perimeter 22 is non circular, then it may optionally include fastening means 50, e.g. Velcro ® closures or snaps, to secure the edges of perimeter when the sack is in a closed configuration (FIG. 6).

Sheet 12 has dimensions large enough to provide a surface useful for a variety of functions. The dimensions, therefore, are a function of the application of the convertible sack. Thus, a convertible sack having a generally circular shape and which is used as a combination beach tote/blanket, has a diameter sufficient to provide a surface upon which an individual can rest or recline. For example, a preferred beach tote/blanket would have a diameter of approximately six feet. If the material has a substantially circular shape, changing the position of the blanket when sunbathing is unnecessary. Instead, the individual merely adjusts his position relative to the sun.

In another embodiment, a combination diaper bag/-changing pad, sheet 12 has dimensions sufficient to provide a surface upon which an infant can be placed. In yet another embodiment, the convertible sack is used as a combination meal tote/seat and sheet 12 has dimensions sufficient to provide a surface upon which food can be placed and/or upon which an individual(s) can sit. As is apparent from these examples, sheet 12 may have a broad size range, depending upon the intended application of the convertible sack. Thus, while sack 10 has been illustrated as having particular relative dimensions in the drawings, the dimensions of the sack are not limited by the exemplary embodiment in the drawinqs, but rather, sack 10 may assume a wide variety of shapes, and have a wide variety of dimensions.

Sheet 12 may be made of natural, e.q. cotton or leather, synthetic, e.g., nylon or plastic, or a combination of natural and synthetic materials. Preferably, sheet 12 is light weight yet strong enough to contain and transport a variety of objects. Sheet 12 is not limited to a single material component but may be a composite of two different components. For example, inner surface 14 can be formed of one fabric and outer surface 16 can be formed of a second fabric. Thus, in one embodiment intended as a combination beach tote/blanket, inner surface 14 is formed of terry cloth and outer surface 16 is formed of canvas or another suitable fabric from which sand can be easily displaced. Inner surface 14 and outer surface 16 are held in position adjacent one another by stitching or by other means known in the art for adhering two overlaying sheets of material. In several preferred embodiments, at least one surface of the convertible sack is formed of a water resistant material or otherwise treated with a protective coating, e.g., Scotchquard ®, to ensure a water resistant surface.

Sack 10 further includes a fastener cord for adjusting the circumference of a opening 26 of the sack. Fastener cord 24 is secured by stitching 20 in circular circumferential section 18 of sheet 12. Circular section 18 refers to the portion of sheet 12, located between a perimeter 22 of the material and stitching 20 for the embodiment of FIG. 1 and to the section between stitching 20 and 22 for the embodiment of FIG. 5. The stitching forms a hollow in the circumferential section through which cord 24 can be threaded. Circular section 18 further includes openings 28 which allow access to the cord. The openings may be present in inner surface 14, outer surface 16 or extend through both surfaces of material 12. Alternatively, the openings may be located at perimeter 22. Preferably, the openings are evenly spaced apart. Pulling cord 24 through openings 28 results in the sack assuming the closed or "sack" configuration illustrated in FIG. 2. The existence of openings 28 which extend through inner surface 14 and outer surface 16 and/or placement of the openings at the perimeter of sheet 12 results in a sack in which inner surface 14 and outer surface 16 can be interchanqed.

Cord 24 is preferably made of a flexible, strong material which is easy to grasp, for example, nylon. The cord serves both as a means for adjusting the circumference of opening 26, thereby effecting conversion between a closed sack and a flat surface, and as a handle for grasping or tying the sack. In one embodiment, sack 10 further includes shoulder straps 30 attached to outer surface 16. Shoulder straps 30 are preferably attached to larger sacks, such as a combination beach tote/blanket, to facilitate carrying.

In one embodiment, cord 24 is made of a synthetic material, e.q., plastic tubing 60 with a stiff wire core 62 which is bendable, but has memory so that it is capable of automatically extending into a fully extended configuration. In this embodiment, releasing the cord results in its automatic extension, thereby facilitating conversion from a sack to a flat configuration. There is no requirement that the fastening cord 24 itself be formed of the above-described material to provide the self-opening feature. For example, a self-opening sack could alternatively be provided by placing a second cord 32 formed of the above-described material, in position parallel to the fastening cord.

Figure 4:
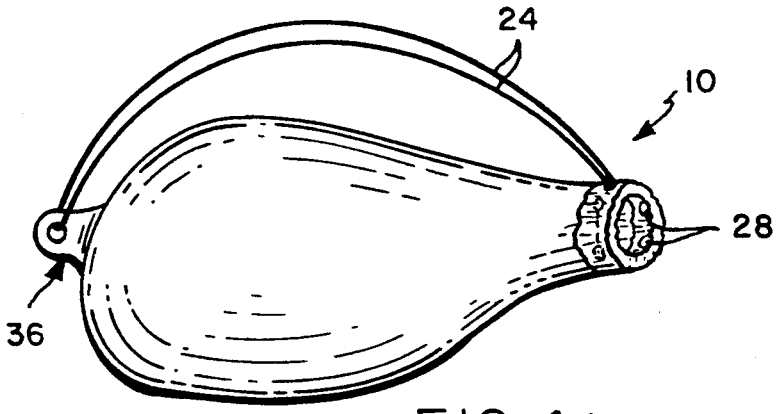
FIG. 4 is a side view of the convertible sack of FIG. 1, shown in a closed configuration with the cord pulled through a single opening.

Fastening cord 24 is held in a gathered position by clamping elements 36 capable of clamping or otherwise securing the cord and thereby maintaining the sack in a closed configuration. Clamping elements 36 may be a clamp, such as those which are available for securing the drawstring of a duffle bag. Other examples of clamping elements include snaps or hook and pile type fasteners, (e.q., Velcro ®) which may be placed around the cord to hold it in a gathered position. The clamp may be attached to or near the circular section of the sack in a manner such that it can be easily located and used. Alternatively, the clamp may be located on outer surface 16 distant from the circular section, to provide a remote position of attachment for cord 24. As shown in FIG. 4, pulling cord 24 through one opening, followed by attachment to a remote clamp 36, results in a relatively long strap for carrying the sack.

Sack 10 may further include attachment elements 34 for attaching additional straps or objects to the sack. Thus, for example, sack 10 may include hooks, snaps or other attachment devices, for attachinq structural supports 38 (e.g., tent poles), to the outer surface of the sack. Supports such as telescopic tent poles, provide a structure upon which the open sack can be disposed, to shield the user from exposure to undesirable weather conditions.

Figure 3:
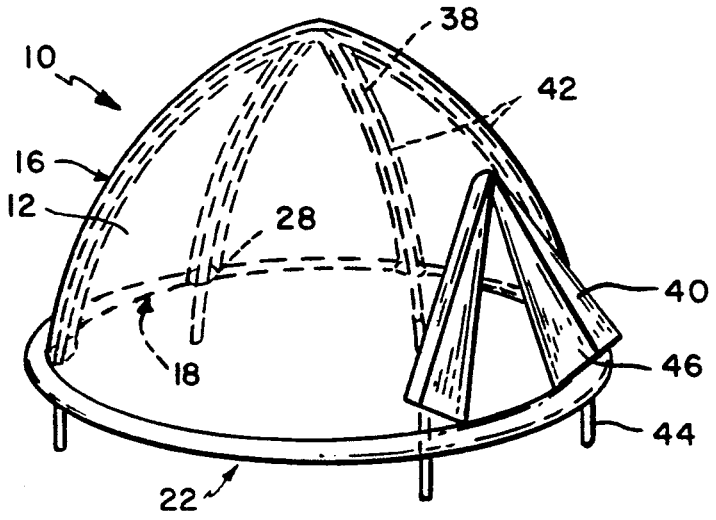
FIG. 3 is a side perspective view of the convertible sack of FIG. 1, shown in a tent like configuration.

Referring to FIG. 3, sack 10 of FIG. 1 is shown in a tent configuration. Sack 10 includes several elements, in addition to supports 38, when the sack is used in a tent configuration. Thus, the sack of FIG. 3, further includes hollow tracks 42 into which telescopic tent supports 38 can be inserted and extended. The hollow tracks are formed in the sack by stitching, in the same manner as previously described in connection with the formation of circular hollow section 18 for containing fastening cord 24. Access to hollow tracks 42 is gained via access openings 28. Supports 38 may be extended to exceed the length of hollow tracks 42, thereby providing a securing end 44 of support 38 for securing the sack/tent to the ground. To enter the sack/tent, sheet 12 may be pushed upwardly, along supports 38, thereby temporarily forming an entrance to the sack tent. Alternatively, sack 10 may also include a separate means for entering the tent. In one embodiment, the means for entering is a slit in the side of the tent to form at least one flap 46. Flap 46 preferably includes a fastener 40, for example, Velcro ® strips or snaps, for securing the flap closed.

Having described the invention in detail, those skilled in the art will appreciate that numerous modifications can be made therein without departing from its spirit. Therefore, it is not intended to limit the breadth of the invention to the embodiments illustrated and described. Rather, the scope of this invention is to be determined by the appended claims and their equivalents.

What is claimed is:

1. A convertible sack, comprising, a sheet formed from a generally flat material and having an inner surface, an outer surface, a circular hollow section formed in said sheet and extending about an outer portion thereof, and a plurality of access openings formed in said section;

a fastener cord secured in said hollow section and reachable at said access openings, the sheet being converted from a flat surface to a sack configuration by pulling said fastener cord through said access openings;

hollow tracks formed in the sheet, said hollow tracks extending across the sheet between non-adjacent access openings; and supports upon which the sheet can be disposed by inserting the supports through the access openings and into the hollow tracks, to form a structure that can shield an individual, the supports including ends extending beyond the access openings for securing the sack to the ground.

2. A convertible sack, comprising a sheet formed from a generally flat material and having an inner surface, an outer surface, a circular hollow section formed in said sheet and extending about an outer portion thereof, and a plurality of access formed in said section;

a fastener cord secured in said hollow section and reachable at said access openings, the sheet being converted from a flat surface to a sack configuration by pulling said fastener cord through said access openings;

hollow tracks formed in the sheet, said hollow tracks extending across the sheet between non-adjacent access openings;

supports upon which the sheet can be disposed by inserting the supports through the access openings and into the hollow tracks, to form a structure that can shield an individual; and means for entering the structure, the means for entering including a slit forming at least one flap in the sheet, and fastener means for securing the flap closed.

3. A convertible sack comprising, a sheet formed from a generally flat material and having an inner surface, an outer surface, a circular hollow section formed in said sheet and extending about an outer portion thereof, and at least one access opening formed in said section;

a fastener cord secured in said hollow section and reachable at said access openings, the sheet being converted from a flat surface to a sack configuration by pulling said fastener cord through said access openings;

means for clamping the fastener cord when in the sack configuration; and means for automatically extending the sheet to a flat configuration when the means for clamping is released.

4. A sack as claimed in claim 3, wherein said means for automatically extending the sheet is formed of a plastic tubing with a stiff wire core.

5. A sack as claimed in claim 3, wherein said means for extending includes a second cord inserted within a hollow of the sheet and positioned parallel to said fastener cord, said second cord automatically extending to a fully extended configuration when the fastener cord is unfastened.

6. A sack as claimed in claim 5, wherein said second cord is formed of a plastic tubing with a stiff wire core.

7. A sack as claimed in claim 3, wherein the sheet is formed of plastic.

8. A convertible sack comprising, a sheet formed from a generally flat material and having an inner surface, an outer surface, a circular hollow section formed in said sheet and extending about an outer portion thereof, and at least one access opening formed in said section;

means for automatically extending the sheet to a flat configuration, said means for extending being secured in said hollow section and being reachable at said access openings, the sheet being converted from a substantially flat configuration to a sack configuration by pulling said means for extending through said access openings; and means for clamping the sheet in the sack configuration, the sheet being automatically extended to a flat configuration when the means for clamping is released.

9. A sack as claimed in claim 8, wherein said means for automatically extending the sheet is formed of a plastic tubing with a stiff wire core.

* * * * *